United States Patent [19]

Grunst

[11] Patent Number: 4,703,141

[45] Date of Patent: Oct. 27, 1987

[54] ACTUATION ATTACHMENT FOR ELECTRICAL CONTROLLING AND SIGNALLING DEVICES, PARTICULARLY FOR EMERGENCY CIRCUIT BREAKERS

[75] Inventor: Heinz Grunst, Marienheide, Fed. Rep. of Germany

[73] Assignee: Square D Starkstrom GmbH, Marienheide-Rodt, Fed. Rep. of Germany

[21] Appl. No.: 766,814

[22] Filed: Aug. 16, 1985

[30] Foreign Application Priority Data

Aug. 23, 1984 [DE] Fed. Rep. of Germany ..... 84110053

[51] Int. Cl.[4] ..... H01H 3/20; H01H 9/24; H01H 13/00

[52] U.S. Cl. ..... 200/340; 200/328; 200/325; 200/153 V

[58] Field of Search ..... 200/43.07, 43.08, 153, 200/309, 302.2, 321, 328, 336, 340, 76, 323–325, 153 E

[56] References Cited

U.S. PATENT DOCUMENTS

| | | | |
|---|---|---|---|
| 3,160,731 | 12/1964 | Gemmell | 200/309 |
| 3,333,079 | 7/1967 | Michaelson, Jr. | 200/336 |
| 3,949,347 | 4/1976 | Gilbreath | 200/156 |
| 4,315,123 | 2/1982 | Fujita et al. | 200/328 |

FOREIGN PATENT DOCUMENTS

| | | | |
|---|---|---|---|
| 1963200 | 12/1970 | Fed. Rep. of Germany | 200/328 |
| 2545369 | 4/1977 | Fed. Rep. of Germany | 200/316 |

*Primary Examiner*—Charles Frankfort
*Assistant Examiner*—W. Morris Worth
*Attorney, Agent, or Firm*—Michael J. Striker

[57] ABSTRACT

An actuation attachment includes a central slider formed at one end with a push button and at the opposite end with a holding piece for an actuator. The slider is inserted in a cylindrical sleeve so as to be movable in axial direction either relative to or in conjunction with the sleeve but engaging it for joint rotation. The sleeve is inserted in a cylindrical bore of a housing to move in axial direction and to rotate about its central axis. The slider is formed with an axially directed slot for accommodating opposite rear ends of two locking pins which are guided in corresponding radially directed bores in the sleeve. The locking pins are urged one from the other by a biasing spring. The cylindrical bore of the housing is formed with axially directed first and second guiding grooves for engaging rounded front ends of the locking pins. Each of the guiding grooves is separated by an inclined stopping surface and a radially directed stopping surface. An inner spring is arranged between the sleeve and the slider and an outer spring is arranged between the slider and the housing. An actuation member for an electrical controlling device is slidably arranged in the housing between the holder member of the slider and the sleeve. The second guiding grooves are provided with sickle shaped run on surfaces to disengage the locking pins from the radially directed stopping surfaces when the slider is turned about its central axis.

13 Claims, 9 Drawing Figures

FIG.3
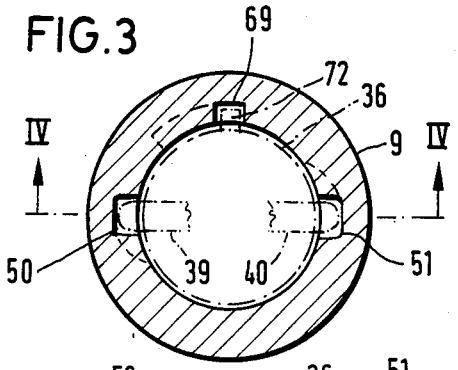
FIG.5
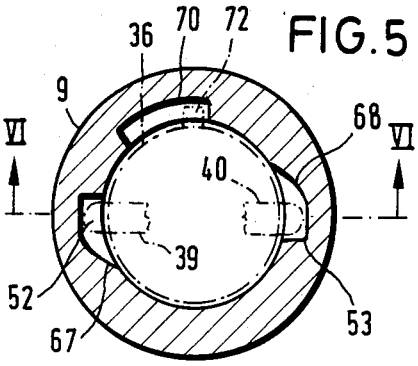
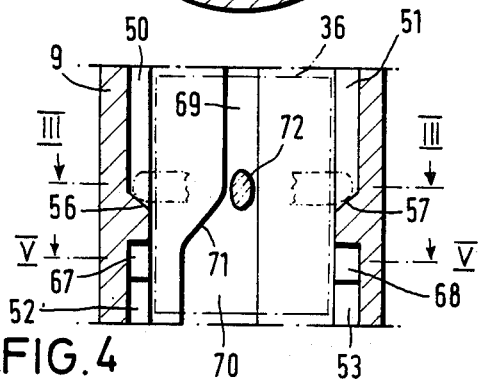
FIG.4
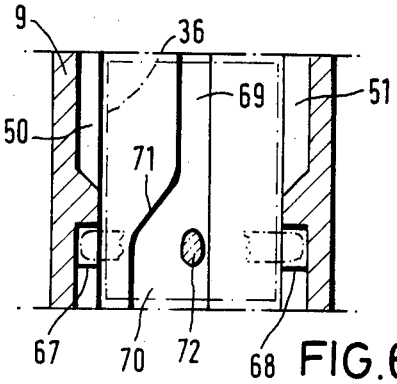
FIG.6
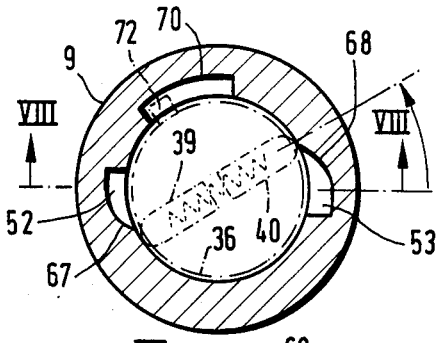
FIG.7
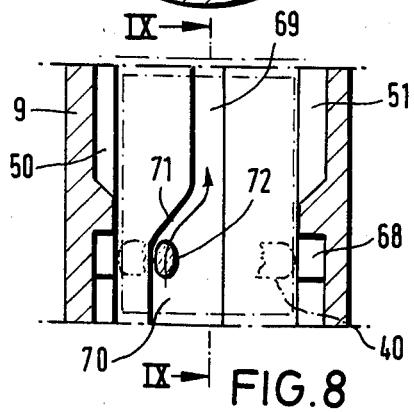
FIG.8
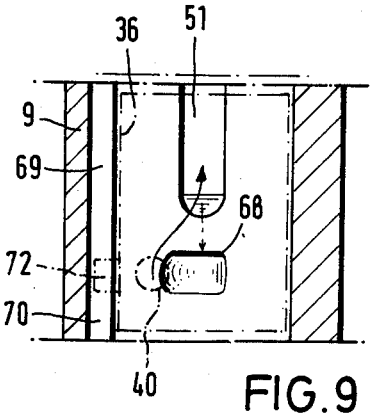
FIG.9

ACTUATION ATTACHMENT FOR ELECTRICAL CONTROLLING AND SIGNALLING DEVICES, PARTICULARLY FOR EMERGENCY CIRCUIT BREAKERS

BACKGROUND OF THE INVENTION

The present invention relates in general to an actuation attachment for use in connection with electric controlling and/or signalling devices, particularly in connection with emergency circuit breakers. The attachment is of the type which includes electric means for holding a device in its operative position whereby a slider which is suitably mounted in a housing, is controlled by means of a push button. The locking means are arranged in a transverse slot extending in axial direction in an intermediate part of the slider and are urged by means of a biasing spring into stopping recesses formed at axially spaced locations in the inner wall of the housing.

An actuation attachment of this kind for a push button switch is known from the German publication DE-A No. 32 07 725. In this prior art embodiment, the slider is provided with an opening in the form of a transverse bore in which two locking balls are arranged and pressed apart from the other by a spring in locking recesses formed in the housing. Between the slider and the housing and between the slider and the push button, there are arranged springs which according to operational position of the switch urge the slider together with a push button from a first rest position to a second rest position. Consequently, it is sufficient to exert a slight pressure on the push button in order to release the locking balls from the first locking recess whereupon the slider is displaced in jump by a biased spring and the locking balls engage the locking recesses in the operative position. To reset the switch in its inoperative rest position the push button is drawn back in axial direction against the force of both springs until the locking balls again engage the locking recesses in the first rest position. The prior art attachment is designed such that any rotation of the push button is avoided and the attachment is still guarded against overload in such a manner that the switching process is released only by depressing the push button whereupon the switching proceeds fully automatically and any outside control is impossible.

From the German publication DE-A No. 41 13 034 a locking device for circuit breakers is known which prevents unintentional resetting of the circuit breaker and indicates whether the circuit breaker has released by itself or whether it was actuated by its emergency key. For this purpose it is provided with a specially designed arresting slider which is movable transversely in the direction of movement of a driving plunger. The arresting slider prevents the resetting of the circuit breaker. To reset the circuit breaker it is necessary to move a driving key in its starting position.

It is true that these prior art devices make it possible to temporarily block their operating position that means the position after actuation. A common characteristic of the above described devices and also of other commercially available constructions of actuation attachments of this kind is the feature that the release from the rest position, for example during emergency switching off, is always affected by light tipping or touch on the push button. It has been repeatedly proved in practice that release of such prior art actuation attachment is made in many instances fully unintentionally and frequently without being noticed for example when being brushed against by a clothing piece of a passing person or when someone carelessly leans against a switching panel in which the electric device is mounted and the like.

SUMMARY OF THE INVENTION

It is therefore a general object of the present invention to avoid the disadvantages of the prior art actuation attachments of this kind.

More particularly, it is an object of this invention to provide an improved actuation attachment which permits the release only by exerting a relatively strong pressure on the actuation knob or push button and then displacing the push button over a relatively long path.

Another object of this invention is to provide such an improved attachment which locks also in its operative position and makes an indication of the latter.

Still another object of this invention is to provide such an improved actuation attachment which does not permit an accidental or a self-suggesting actuation, to return in its rest position.

In keeping with these objects and others which will become apparent hereinafter, one feature of the invention resides in a combination in which a slider is surrounded by a shiftable sleeve which is formed with two opposite radially directed openings through which pass locking elements in the form of hollow pins; the slider has at its central portion a cutout or opening which enlarges in the direction of movement of the slider and accommodates a biasing spring for the locking element; an outer pressure spring arranged between the top part of the slider and an end face of the housing, and an inner pressure spring arranged between the top part of the slider and the sleeve; the inner wall of the housing being formed with first and second locking recesses, the second locking recesses being provided with run-on surfaces which permit the release from the second stop surfaces only after the push button is rotated about its central axis; and at the lower portion of the slider an actuation member is attached which is movable in the lower part of the sleeve.

In this manner it is achieved that an unintentional contact or like depression of the push button cannot release the device and the push button remains in or return to its original position. Only by exerting a strong pressure on the push button and overcoming a distinct resistance the release takes place in a sudden jump. The locking of the actuation attachment in operating positions is accomplished by simple technical means and is reliably held in position and can be withdrawn only by turning the push button.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a simplified transverse section of the attachment of FIG. 1 taken along the line III—III;

FIG. 4 is a sectional elevation view of a cut-away part of the device of this invention taken along the line IV—IV in FIG. 3;

FIG. 5 is a transverse section taken along the line V—V in FIG. 4;

FIG. 6 is a sectional elevational view taken along the line VI—VI in FIG. 5;

FIG. 7 is a transverse section of a simplified device of this invention taken in the range of the second locking surfaces;

FIG. 8 is a sectional elevation view taken along the line VIII—VIII of FIG. 7; and FIG. 9 is a sectional elevation view taken along the line IX—IX in FIG. 8.

DESCRIPTION OF THE PREFERRED EMBODIMENTS

Figure 1:
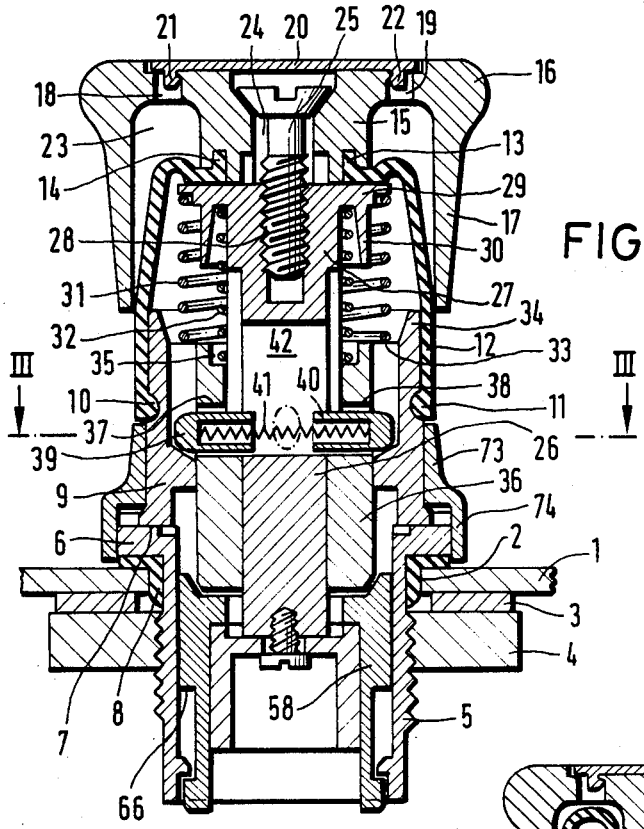
FIG. 1 is a sectional elevation view of an actuation attachment of this invention shown in its rest position.
Figure 2:
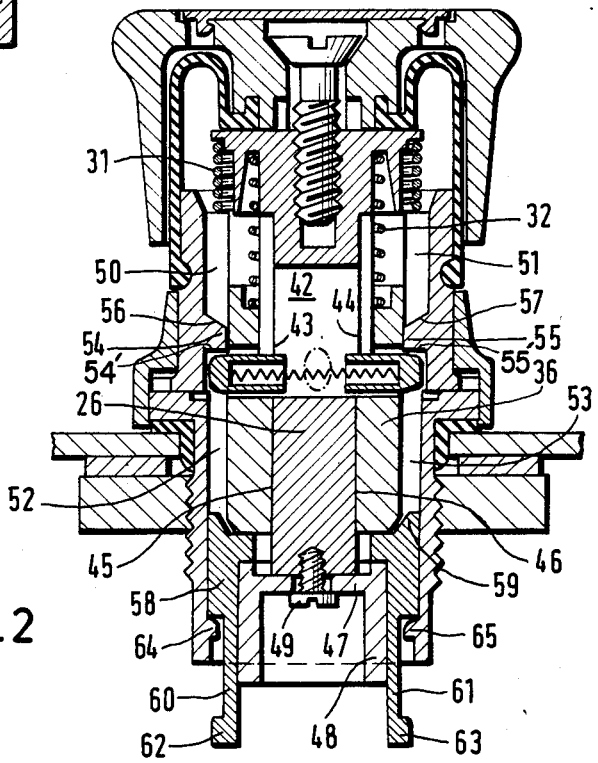
FIG. 2 is a view similar to FIG. 1 but showing the attachment in its operative position.

The embodiment of the actuation attachment illustrated in FIGS. 1 and 2 is designed for being mounted on an installation plate 1 which is provided with a hole 2 through which a lower part of the attachment is inserted. The lower part consists of a threaded attachment piece 5 whose upper collar 6 rests on a flange of a cylindrical insert 8 engaging the upper surface of the mounting plate 1. The threaded piece 5 is secured to the mounting plate by a nut 4 with washer 3. The collar 6 of the attachment part 5 suppports the bottom 7 of housing 9. The lower portion of housing 9 is enclosed by a cylindrical jacket 73 which transits at its lower end into an expanded portion 74 of a circular or quadratic cross-section which encloses the correspondingly shaped contour of the cylindrical insert 8 and of the collar 6. About midway of the height of the jacket of the housing 9 there is provided a circumferential groove 10 into which an annular bulge 11 formed at the lower edge of a flexible sealing cap 12 is inserted. The upper edge 13 of the sealing cap 12 is attached in an annular groove 14 in an inner cylindrical projection 15 of a hollow push button 16. In this manner the flexible cap 12 which can be made of rubber, for example, protects all movable parts of the attachment (which will be explained below) against outside contamination by dust. The outer jacket 17 of the push button surrounds an upper portion of the flexible cap 12 and is spaced apart radially from the cylindrical projection 15 to create an interspace 23 into which the flexible cap 12 is accommodated when the push button is depressed into an actuated position illustrated in FIG. 2. The top face of push button 16 is formed by an indicator plate 20, for example red plate in the case of an emergency circuit breaker, provided with arresting projections 21 and 22 which snap engage recesses 18 and 19. In this manner the indicator plate 20 is exchangeable.

The inner cylindrical projection 15 of the push button 16 is formed with a central bore 24 for receiving a fastening screw 25 by means of which the push button 16 is secured to the top face of slider 26. The end face of the cylindrical projection 15 partially rests on the end face of the slider 26 and partially clamps the upper edge 13 of the sealing cap on a shoulder 29 of a head portion 27 of the slider 26.

The slider 26 has an intermediate portion which is partially surrounded by a cylindrical sleeve 36 as shown in FIGS. 1 and 2. The shoulder 29 of the head part of the slider is formed with a downwardly directed annular projection 30. An outer pressure spring 31 is provided between the rim of the shoulder 29 and the top end of housing 9 to urge the push button 16 into its rest position. An inner pressure spring 32 is arranged between the shoulder 29 of slider 26 and the top face of the sleeve 36. The inner spring 32 extends at one end thereof in the space between annular projection 30 and the head part 27 of the slider 26, and at the other end thereof it rests in an annular recess 35 formed in the top end of sleeve 36. Similarly, to fix the outer pressure spring 31 in its position, the top end of housing 9 is provided with a guiding rim 34. The end parts of springs 31 and 32 are separated by the annular wall 30 which also contributes to holding the springs in their position.

The sleeve 36 is formed with two opposite radially directed bores 37 and 38 through which locking means in the form of hollow pins 39 and 40 project. The outer ends of hollow pins 39 and 40 are rounded to form semi-spherical guiding surfaces. The inner ends of hollow pins are accommodated in a guiding slot formed in the intermediate part of the slider 26 and are urged in opposite radial directions one from the other by a biasing spring 41, which is inserted in the blind bores of both pins. The length of both pins 39 and 40 is dimensioned such that in a compressed condition of the biasing spring 41 which will be described later the spherical outer ends of the pins are flush with the cylindrical wall of the sleeve 36 while sufficient clearance is left between the opposite inner ends of the pins 39 and 40. The slot 42 in the slider 26 extends in the direction of movement of the latter and increases in width towards the head or upper portion of the slider, namely in the illustrations of FIGS. 1 and 2, it increased upwards so that in the depressed condition of the slider the pins 39 and 40 are free to move in opposite directions relative to each other in respective radial bores 37 and 38.

The slider 26 has a substantially cylindrical configuration with flat opposite guiding surfaces 43 and 44 which are in sliding contact with corresponding flat guiding surfaces 45 and 46 on the inner wall of the sleeve 36. In this manner, the slider 26 and the sleeve 36 are movable relative to each other in axial direction but are locked for joint rotation about their common central axis.

A cup shaped holding element 47 is secured by a fastening screw 49 to the center of the lower end face of the slider 26. The cylindrical guiding jacket 48 of the holding member 47 slidably engages the cylindrical inner surface of a cup shaped actuation member 58 which activates a non-illustrated electric control or signalling device. In the rest position of the attachment, annular bottom of the actuation member 58 rests on the outer edge of the holding member 47. The outer bottom surface of the actuation member 58 is formed with a frustoconical recess defining a sloping rim 59 for guiding beveled lower edge of sleeve 36. The downwardly directed end face of the actuation member 58 is provided with axially downwardly directed bars 60 and 61 terminating with abutment members 62 and 63 which in the rest position of the attachment abut against stop members 64 and 65 in the inner wall of the threaded piece 5.

The cylindrical inner wall of the housing 9 is formed with two opposite axially directed upper guiding grooves 50 and 51 and with lower guiding grooves 52 and 53 which are separated from the first mentioned grooves by stopping projections 54 and 55 forming an integral part of housing 9. The clearance of the guiding grooves 50 through 53 is dimensioned such as to guide the projecting ends of locking pins 39 and 40 with a certain play. The upper guiding grooves 50 and 51 together with the sloping surfaces 56 and 57 of the stopping projections 54 an 55 form the first locking location whereas the lower guiding grooves 52 and 53 together with the radially directed lower surfaces 54' and 55' of the projections 54 and 55 represent the second locking location. The end faces of the stopping projections 54 and 55 are parallel with the inner cylindrical surface of the housing 9 and slidably engage the sleeve 36.

The second locking locations, as it will be described below are shaped in such a manner as to permit unlocking of the pins 39 and 40 from the position illustrated in FIG. 2 only by rotating the push button 16 about its central axis.

Referring now to FIGS. 3 to 9, the lower guiding grooves 52 and 53 have a sickle shaped cross-section including curved run on surfaces 67 and 68 transiting in the same direction in the cylindrical inner wall of housing 9 (FIGS. 5 and 7). Consequently, when rotating the push button 16 in the direction of curved surfaces 67 and 68, the pins 39 and 40 are pressed against their biasing spring 41 and move radially inwardly in the bores 37 and 38 until they fully compress the spring 41 and enter the sleeve 36 and the slider 26 as far as to the inner wall of the housing 9. Preferably the curved run on surfaces 67 and 68 slope toward the inner wall of the housing 9 in clockwise direction so that the push button 16 be rotated clockwise when it is desired to release the attachment from its locking position illustrated in FIG. 2.

It will be seen from FIGS. 6, 8 and 9, the inner wall of housing 9 is provided also with an additional guiding groove 69 which is staggered relative to the grooves 52 and 53 by an angle of about 90° . In the range of the upper guiding grooves 50 and 51, the additional groove 60 has a clearance sufficient to accommodate with a certain play a pin 72 formed on the cylindrical outer surface of the sleeve 36 at a location which is also staggered relative to the holes or pins 39 and 40 by about 90° . In the region of the stopping projections 54 and 55, one side of the groove 69 transits via a sloping surface 71 into a guiding groove 70 of increased clearance.

The operation of the actuation attachment of this invention is as follows:

When the attachment in its rest position illustrated in FIG. 1, then the abutments 62 and 63 of the actuation member 68 engage the stop pieces 64 and 65 on the threaded part 5. The actuation member 68 is held in this uppermost position by the action of the outer pressure spring 31 which exceeds the bias of the inner pressure spring 32. The semi-spherical outer ends of pins 39 and 40 rest on the sloping surfaces 56 and 57 in the first stopping location at the lower ends of upper guiding grooves 50 and 51. When an operator presses the push button 16 downwardly, then both springs 31 and 32 are compressed and slide 26 together with holding member 47 are displaced downwardly to the position shown in FIG. 2. Due to the diverging cross-section of the slot 42, the hollow pins 39 and 40 together with outer sleeve 36 remain in the original locking position on the first stopping location as shown in FIG. 1 and no pressure is exerted on the actuation member 58. Accordingly, if the operator decides to release the pressure on the push button 16 so the latter returns by the action of outer spring 31 into its starting position without causing the activation or switchover of an electric controlling or signalling device by the actuation member 58. Only after the push button 16 is depressed intentionally with an increased force which overcomes not only the biasing force of the outer spring 31 but also of the inner spring 32, the locking pins 39 and 40 are displaced radially inwardly by the sloping surfaces 56 and 57 until the biasing spring 41 is brought into its fully compressed condition and the outer surfaces or the spherical ends of these pins are completely in the sleeve 36. At this moment the inner spring 32 abruptly pushes the sleeve 36 together with the actuator 58 downwards. The rods 60 and 61 of the actuator engage a non-illustrated electric controlling or signalling device and activate the same. The stroke of the sleeve 36 and of the actuation member 58 relative to the depressed slider 26 is limited by the stop pieces 64 and 65, namely by the abutment of the step 66 at the lower end of the actuation member 58 against the inner surfaces of the stop pieces 64 and 65 on the inner wall of attachment part 5 (FIG. 2). At the same time, as soon as the locking pins 39 and 40 are moved past the stopping projections 54 and 55 in the range of the lower guiding grooves 52 and 53, the biasing spring 41 displaces the pins 39, 40 radially outwardly and when the operator releases the push button, the outer pressure spring moves the slider 26 together with the locking pins into their second locking location at the upper end of the lower guiding grooves 52 and 53 as shown in FIG. 2. The bolt of push button 16 in this second locking position indicates that the electric controlling or signalling device has been activated. The actuation of the electric controlling device cannot be interrupted by repeated depression of the push button or by its pulling in the opposite direction inasmuch as in the second locking position the locking pins engage the above described lower locking surfaces 54', 55' of the projections 54 and 55 which extend perpendicularly to the central axis of the attachment.

If, however, it is intended to inactivate or interrupt the switching process, then the push button 16 is rotated about its central axis as indicated by curved arrow in FIG. 7. The spherical end surfaces of hollow pins 39 and 40 are moved on the curved surfaces of the sickle shaped portions 67 and 68 of the second guiding grooves 52 and 53 and are displaced radially inwardly against their biasing spring 41 until they are flush with the cylindrical inner wall of the housing 9. The rotary movement imparted to the push button 16 by the operator is transmitted first to the slider 26 and to the sleeve 36 but not to actuation member 58 whose bars 60 and 61 are still in engagement with the electric controlling device. In rotating the sleeve 36 its pin 72 engages the sloping surface 71 between the guiding groove 69 and 70 and is brought from the position illustrated in FIG. 6 into the position illustrated in FIG. 8. In the latter position, the pin 72 abuts against a side of the extended guiding groove 70 which thus limits the rotary movement of the push button 16. If at this moment the push button 16 is released, then in the position of locking pins 39, 40 and of the pin 72 shown in FIGS. 7 and 8, the outer biasing spring 31 displaces the slider 26 together with the sleeve 36 upwards whereby the pin 72 slides along the inclined surface 71 and returns the push button in its original position shown in FIG. 4. During this return movement, the rounded ends of hollow pins 39 and 40 slide in the direction of arrow, as indicated in FIG. 9, on the cylindrical inner wall of housing 9 until they reengage the upper guiding grooves 50 and 51 and are brought in their first locking location on the sloping surfaces of the projections 54 and 55.

The previously described annular projection 30 and the head part 27 of the slider 26 have not only the function of separating the ends of pressure spring 31 and 32 but also perform the following important function: if by accident one of the pressure springs 31 or 32 is clamped so that its biasing force is reduced or even neutralized then the projection 30 insures that the other spring is fully effective. Moreover, the height of the projection 30 is so dimensioned that in the compressed condition of the spring 31 its free end reaches the upper end of the sleeve 36 and possibly pushes the sleeve downwards. In this manner, the switching off of an emergency circuit breaker for example, is always accomplished.

It will be understood that each of the elements described above may also find a useful application in other types of constructions differing from the types described above.

While the invention has been illustrated and described as embodied in a specific example of an actuation attachment for an electric control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An actuation attachment for an electric controlling or signalling device, comprising a tubular housing having an inner wall defining a central axis; a sleeve arranged in said housing for movement along and around said central axis, the sleeve having two opposite ends and a jacket formed with two radially directed openings; a cylindrical slider arranged in said sleeve for movement along and around said central axis, the slider having two opposite ends and a jacket formed with an axially directed slot diverging towards one of said ends, said slider being coupled to the sleeve for joint rotation therewith and for an axial movement either relative to or in conjunction with the sleeve; locking means arranged in said slot of the slider and being spring biased to project through said openings in said sleeve; first and second axially directed guiding means formed one above the other in the inner wall of said housing to guide said locking means, said first guiding means being provided at their lower ends with inclined stopping surfaces for engaging said locking means when said sleeve and said slider are in a rest position, said second guiding means being provided at their upper ends with radially directed stopping surfaces for holding via said locking means said sleeve and said slider in an actuated position, said second guiding means being further provided with axially directed curved run on surfaces for disengaging said locking means from said radially directed stopping surfaces when the slider is turned around said center axis; an actuation member arranged in said housing below one end of said sleeve, said actuation member being movable along said center axis between a rest position in which it is disengaged from an electric controlling or signalling device, and an actuated position in which it activates said device; a holding member secured to one end of said slider and slidably guiding and supporting said actuation member; an outer pressure spring arranged between said housing and a second end of said slider to urge the slider into said rest position; an inner spring arranged between said second end of the slider and a second end of said sleeve to displace by snap action the sleeve and slider thereby forcing said actuation member into said actuated position when the slider is depressed by an operator beyond a point at which said locking means disengage said inclined stopping surfaces.

2. An actuation attachment as defined in claim 1, wherein said other end of said slider is formed with a radially extended head part, and further including a push button secured to said head part.

3. An actuation attachment as defined in claim 2, wherein said curved run on surfaces of said second guiding means have a sickle shaped cross-section oriented in the same direction so that during turning of the push button said locking means are displaced radially inwardly until flush with the inner wall of said housing.

4. An actuation attachment as defined in claim 3, further comprising an axially directed guiding groove formed in the inner wall of said housing and being staggered relative to said first and second guiding means by an angle of about 90° when viewed in an axial direction of the inner wall, one side of the axial guiding groove in the region between said inclined stopping surfaces and said radially directed stopping surfaces being inclined relative to the opposite side such as to increase clearance of the axial guiding groove below said radially directed stopping surfaces; and a pin formed on the outer surface of said sleeve to slidably engage said axial guiding groove.

5. An actuation attachment as defined in claim 4, further comprising an annular projection extending downwardly from said enlarged head part of said slider, end portions of said inner and outer springs resting on said head part and being sparated by said annular projection.

6. An actuation attachment as defined in claim 5, wherein said actuation member is provided with two opposite axially directed bars terminated with radially directed abutment pieces, and said inner wall of the housing being formed with stop pieces cooperating with said actuation member and with said abutment pieces to delimit the stroke of said actuation member.

7. An actuation attachment as defined in claim 1, wherein said housing includes a detachable threaded part formed with a collar, said threaded part being insertable into a hole of a mounting panel.

8. An actuation attachment as defined in claim 1, wherein the slider has a cylindrical outer surface formed with two opposite axially directed flattened surfaces which slidably engage correspondingly flattened opposite axially directed surface on said sleeve to provide coupling for joint rotation of said sleeve and said slider.

9. An actuation attachment as defined in claim 1, wherein said first and second guiding means are axially directed grooves arranged one above the other in the inner wall of said housing.

10. An actuation attachment as defined in claim 9, wherein said first and second guiding grooves are separated by projections each being formed with said inclined stopping surface and said radially directed stopping surface and being flush with an outer wall of said sleeve.

11. An actuation attachment as defined in claim 2, wherein said housing has a cylindrical outer wall formed with a circumferential groove, a tubular sealing cap of a flexible material clamped at one end thereof into said circumferential groove, said push button being formed with a cylindrical central projection resting on said other end of said slider, the other end of said sealing cap being clamped to the other end of the slider by said cylindrical projection, said push button having an outer annular jacket forming with said central cylindrical projection an interspace for accommodating a folded part of said sealing cap when said push button is in its depressed condition.

12. An actuation attachment as defined in claim 11, wherein said push button has an end face formed with a depression for receiving an indicator plate, said indicator plate having snap fingers for snap engaging corresponding recesses in said end face.

13. An actuation attachment as defined in claim 1, wherein said locking means includes two hollow pins each having a semispherial end for engaging said stopping surfaces, and an open end for accommodating a biasing spring.

* * * * *